US006894649B2

(12) United States Patent
Östervall

(10) Patent No.: US 6,894,649 B2
(45) Date of Patent: May 17, 2005

(54) ANTENNA ARRANGEMENT AND PORTABLE RADIO COMMUNICATION DEVICE

(75) Inventor: Torsten Östervall, Bromma (SE)

(73) Assignee: AMC Centurion AB, Akersberga (SE)

( * ) Notice: Subject to any disclaimer, the term of this patent is extended or adjusted under 35 U.S.C. 154(b) by 77 days.

(21) Appl. No.: 10/312,564

(22) PCT Filed: Jul. 10, 2001

(86) PCT No.: PCT/SE01/01601

§ 371 (c)(1),
(2), (4) Date: Jan. 10, 2003

(87) PCT Pub. No.: WO02/05381

PCT Pub. Date: Jan. 17, 2002

(65) Prior Publication Data

US 2004/0090384 A1 May 13, 2004

(30) Foreign Application Priority Data

Jul. 10, 2000 (SE) ..... 0002599
Dec. 20, 2000 (SE) ..... 0004724

(51) Int. Cl.[7] ..... H01Q 1/24
(52) U.S. Cl. ..... 343/702; 343/700 MS
(58) Field of Search ..... 343/700 MS, 702, 343/846, 725, 728, 726, 727, 729

(56) References Cited

U.S. PATENT DOCUMENTS 5,760,747 A * 6/1998 McCoy et al. ..... 343/728
6,295,030 B1 * 9/2001 Kozakai et al. ..... 343/700 MS
6,483,463 B2 * 11/2002 Kadambi et al. .... 343/700 MS
6,549,169 B1 * 4/2003 Matsuyoshi et al. ..... 343/702
6,768,460 B2 * 7/2004 Hoashi et al. ..... 343/700 MS

FOREIGN PATENT DOCUMENTS

| | | |
|---|---|---|
| EP | 0817312 A2 | 1/1998 |
| EP | 1024552 A2 | 8/2000 |
| EP | 1052722 A2 | 11/2000 |
| GB | 2316540 A | 2/1998 |
| WO | WO90/13152 | 11/1990 |

* cited by examiner

*Primary Examiner*—Hoang V. Nguyen
(74) *Attorney, Agent, or Firm*—Jacobson Holman PLLC

(57) ABSTRACT

The present invention relates to an antenna arrangement for a portable radio communication device including a casing, said casing housing a generally planar printed circuit (1) board defining a ground plane device. The antenna arrangement comprises: a first antenna element (4; 5) for transmission of radio signals mountable within said casing and connectable to said printed circuit board; and a second antenna element (7; 9; 11) for reception of radio signals mountable within said casing and connectable to said printed circuit board. The first antenna element, when mounted above said printed circuit board, has a projection on said printed circuit board, which is perpendicular to a plane parallel to said generally planar printed circuit board, wherein said first antenna element has a size and is positioned such that said printed circuit board extends, in all directions of said plane, farther than the projection, at least by a distance of one millimeter. With such an antenna arrangement it is possible to increase the power level a portable radio communication device without increasing SAR.

17 Claims, 5 Drawing Sheets

ANTENNA ARRANGEMENT AND PORTABLE RADIO COMMUNICATION DEVICE

This is a nationalization of PCT/SE01/01601 filed Jul. 10, 2001 and published in English.

FIELD OF INVENTION

The present invention relates generally to internal antenna arrangements and more particularly to an internal antenna arrangement for use in a portable radio communication device, such as a mobile phone.

BACKGROUND

Modern mobile phones are getting smaller and smaller and thus the interaction between antenna, phone body and user will become more important than earlier. It is well known that the size of an antenna is critical for its performance. There is also normally a requirement today that two or more frequency bands are supported.

Mobile phones generally exchange radio signals with a radio base station. Some signal exchange occurs during standby when no call is going on and the phone is located for instance in the hand, in a pocket, or at the waist of the user. Signal exchange of course occurs when a call is going on and the phone is then typically located between the ear and mouth of the user, or still in a pocket or at the waist of the user with an earpiece and a microphone connected.

A fundamental and efficient antenna type for mobile telephone is the monopole consisting of an antenna whip having a length generally a fraction of a wavelength and a phone circuit board acting as a corresponding ground conductor. Among them a length of half a wavelength was used in many older phones and gives a very low feeding current (corresponding to high impedance) with low currents on the telephone body or circuit board. This type of antenna provides very low electromagnetic fields on the phone itself and thus little interaction with head, hands etc close to the phone. However, the size is much bigger than complying with modern telephone design so generally much smaller antennas are required for the sake of easy handling.

However, since the small antenna has to radiate the same power as a large one (due to the requirements of the phone system) the currents or voltages (depending on the type of antenna) on the small antenna will be larger. This is especially true when the structure is small as compared to a wavelength. Thus the possible interaction with various objects close to the antenna will inherently be larger and so will the currents along the phone body or circuit board. This applies to all typical screeners in telephone surroundings, which means that the electromagnetic fields of the antenna will interact significantly with the user's body during call mode. The interaction would generally occur during standby as well as if the phone is close to the user's body.

When dealing with interaction between the telephone antenna and its immediate surroundings, the electromagnetic near field of the antenna is more important than the far field. In this interaction, there are at least two different quantities to consider.

One is the power loss in the surroundings consisting of losses in for instance a table, a bag, or in a hand, a head and other human tissue. Such losses have to be considered when designing an antenna for a mobile system, as the phone systems require a certain power level (such as 2W peak and 0.25 W in average for GSM). Another quantity is Specific Absorption Rate (SAR) which is relevant in countries where there is legislation and regulation defining SAR upper limits as the power loss per a certain unit of body tissue, generally quantified as an average in watts per a certain amount of body tissue. For instance, the FCC (Federal Communications Commission) in the USA requires that SAR be less than 1.6 mW in average per gram of body tissue. Different antennas and phones exhibit different SAR for the same radiated power. According to standards (FCC, CENELEC and others), SAR is measured inside a dummy head.

Due to the general desire of obtaining as large signal strength as possible of a mobile phone, an internal antenna element is traditionally designed to be as large as possible, i.e. extending beyond the PCB or at least right up to an edge of the PCB.

SUMMARY OF THE INVENTION

An object of the present invention is to provide an antenna arrangement for use in a portable radio communication device, wherein the power level of the antenna arrangement may be increased without increasing SAR or SAR may be decreased with an unchanged power level of the antenna arrangement.

This object, among others, is attained by antenna arrangements as claimed in the appended claims.

The present invention is based on the realization that when an antenna arrangement in a portable radio communication device is divided into a transmitting antenna element (Tx) and a receiving antenna element (Rx) it is possible to lower SAR from the antenna arrangement if the transmitting antenna element (Tx) is provided away from the edge of a PCB of a portable radio communication device, as reception of radio signal contribute weakly to SAR compared to transmission of radio signals. It is thus possible to increase the transmission power level without increasing SAR or to decrease SAR with an unchanged transmission power level.

An advantage with separated Tx and Rx antenna elements is that a pure transmitting antenna or receiving antenna is easier to tune than a transceiver antenna, and thus a lower transmission power on a transmitting antenna achieves the same result as a higher transmission power on a transceiver antenna. As a result thereof SAR is lowered.

A further advantage is achieved if the Tx antenna element is unbalanced and the Rx antenna element is balanced, or vice versa, since the coupling between the antenna elements are lowered and the transceiver antenna element is further easy to tune, allowing a lower transmission power and thus lower SAR.

Further features and advantages of the present invention will be evident from the following description.

BRIEF DESCRIPTION OF THE DRAWINGS

The present invention will become more fully understood from the detailed description of embodiments given below and the accompanying figures, which are given by way of illustration only, and thus, are not limitative of the present invention, wherein.

DETAILED DESCRIPTION OF EMBODIMENTS

In the following description, for purpose of explanation and not limitation, specific details are set forth, such as particular techniques and applications in order to provide a thorough understanding of the present invention. However, it will be apparent for a person skilled in the art that the present invention may be practiced in other embodiments that depart from these specific details. In other instances, detailed description of well-known methods and apparatuses are omitted so as not to obscure the description of the present invention with unnecessary details.

Figure 1:
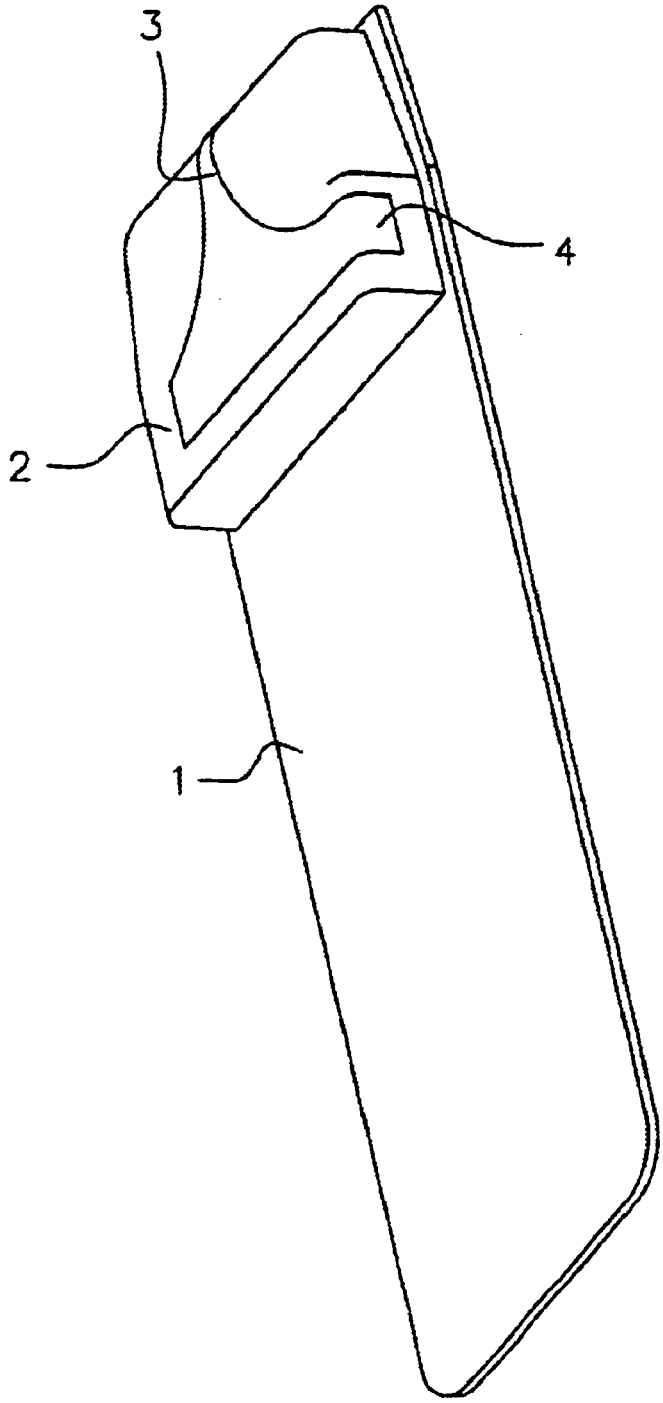
FIG. 1 is a schematic perspective view of a first embodiment of an antenna arrangement according to the present invention.

A first embodiment of the present invention will now be described with reference to FIG. 1.

A stripped portable radio communication device, such as a mobile phone, comprises a generally planar printed circuit board (PCB) 1 and an antenna arrangement for providing radio communication. The antenna arrangement includes a transmitting antenna element 3, 4 for providing transmission of radio signals, supported by a dielectric support 2, and a receiving antenna element (not shown). The transmitting antenna element consists of a feeding portion 3 and a resonating portion 4. The resonating portion 4 consists of an essentially planar portion parallel to the PCB 1 and another essentially planar portion perpendicular to the PCB 1. The two resonating portions are joined in a bend with a small bending radius.

The PCB 1 functions as a ground plane device, screening the antenna elements, due to conducting paths and electric circuits and components mounted thereon. The PCB 1 is among other things provided with components for radio frequency (RF) functionality connected to feeding portions of the antenna elements.

The transmitting antenna element is mounted within the general outline of the PCB 1, limited by the edges of the generally planar surface of the PCB 1. The transmitting antenna element is positioned slightly within all edges of the PCB 1, at least by a distance of one millimeter. By positioning the transmitting antenna in this way measurements show that SAR can be lowered by 14% as compared to positioning the transmitting antenna element right to an edge of the PCB. The distance may be at least two or three millimeters or even more, achieving even lower SAR.

The reduction of SAR may, if not needed to comply with legislation or regulations, instead be utilized to increase transmission power, without increasing SAR as compared to a mobile phone with the transmitting antenna element right up to an edge of the PCB 1.

The receiving antenna element contributes to SAR only marginally and the position thereof is therefore not very important. Positions of receiving antenna elements relative transmitting antenna elements and PCB will be described below.

Preferably, the transmitting antenna element is positioned equally distanced from the two opposing longitudinal edges of the PCB 1, i.e. positioned half way between the two opposing longitudinal edges of the PCB 1.

The transmitting antenna element may be unbalanced and the receiving antenna element may be balanced, or vice versa, lowering the coupling between the antenna elements Allowing easier tuning of the transceiver antenna element and thus a lower transmission power.

Figure 2:
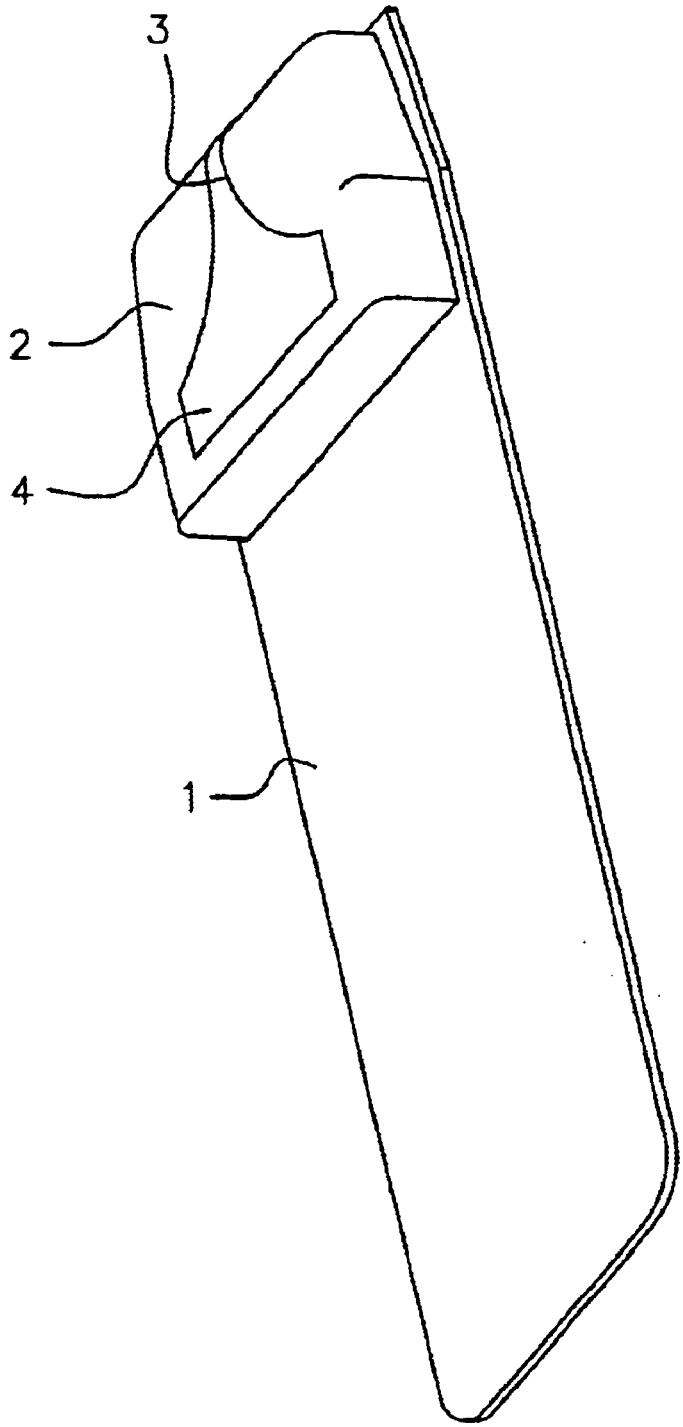
FIG. 2 is a schematic perspective view of a second embodiment of an antenna arrangement according to the present invention.

A second embodiment of the present invention will next be described with reference to FIG. 2.

This second embodiment of the present invention is identical with the first embodiment described above except that the resonating portion of the transmitting antenna element only consists of an essentially planar portion parallel to the PCB 1.

By positioning the transmitting antenna element in this way, without an essentially planar portion perpendicular to the PCB 1, measurements show that SAR can be lowered by 34% as compared to positioning the transmitting antenna element right to an edge of the PCB 1.

Figure 3:
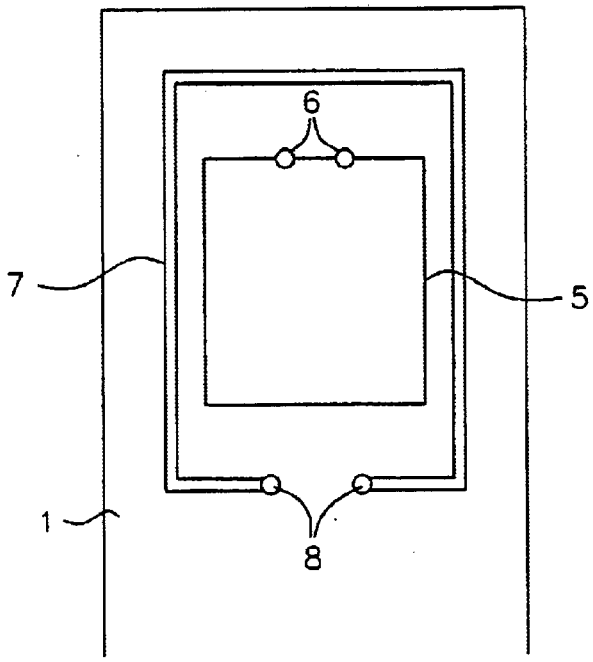
FIG. 3 is a schematic plan view of a third embodiment of an antenna arrangement according to the present invention.

A schematic illustration of the relative positions of a transmitting antenna element and a receiving antenna element on a PCB, only a part of which is shown, according to a third embodiment of the present invention will now be described with reference to FIG. 3.

The transmitting antenna element 5 is a planar antenna positioned half way between two opposing longitudinal edges of the PCB 1 of a portable radio communication device, such as a mobile phone. The distance to the edges is at least one millimeter. Two feeding points 6 of the transmitting antenna element 5 are shown near the top of the PCB 1.

The receiving antenna element 7 is a loop antenna positioned surrounding the transmitting antenna element 5. Two feeding points 8 of the receiving antenna element 7 are shown away from the top of the PCB 1, i.e. on the part of the receiving antenna element 7 facing away from the top of the PCB 1.

Figure 4:
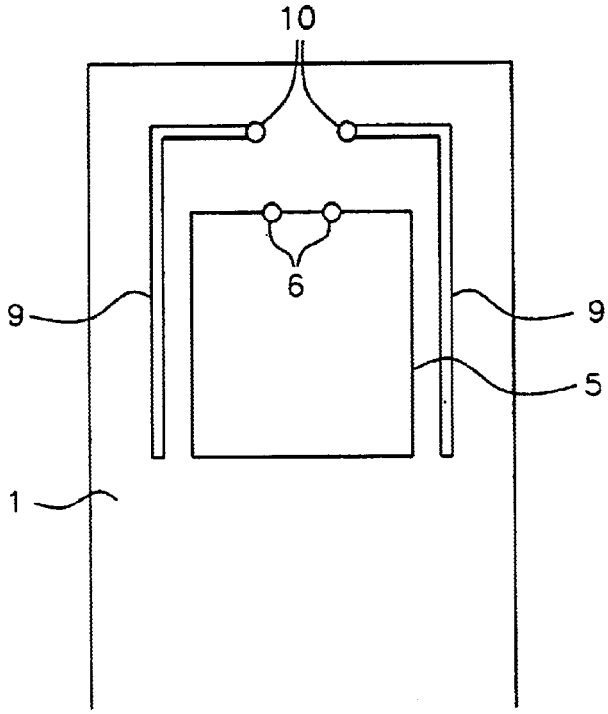
FIG. 4 is a schematic plan view of a fourth embodiment of an antenna arrangement according to the present invention.

Next a schematic illustration of the relative positions of a transmitting antenna element and a receiving antenna element on a PCB, only a part of which is shown, according to a fourth embodiment of the present invention will be described with reference to FIG. 4.

The transmitting antenna element 5 is a planar antenna positioned half way between two opposing longitudinal edges of the PCB of a portable radio communication device, such as a mobile phone. The distance to the edges is at least one millimeter. Two feeding points 6 of the transmitting antenna element 5 are shown at the top of the PCB 1.

The receiving antenna element 9 is a dipole antenna positioned between the transmitting antenna element and the outline of the PCB, surrounding the transmitting antenna element 5 on three sides thereof. Two feeding points 10 of the receiving antenna element 9 are shown at the top of the PCB 1. The dipole antenna may alternatively be fed by one common feeding point.

Figure 5:
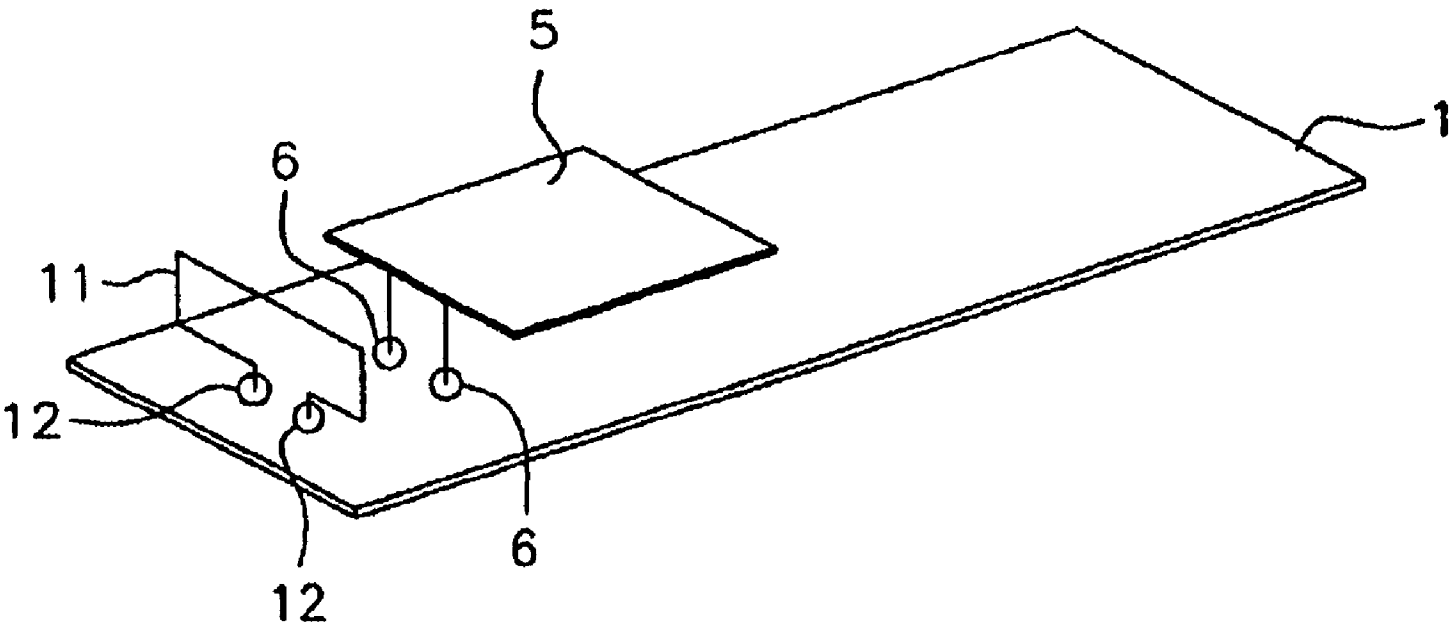
FIG. 5 is a schematic perspective view of a fifth embodiment of an antenna arrangement according to the present invention.

A schematic illustration of the relative positions of a transmitting antenna element and a receiving antenna element on a PCB according to a fifth embodiment of the present invention will now be described with reference to FIG. 5.

The transmitting antenna element 5 is a planar antenna positioned half way between two opposing longitudinal edges of the PCB 1 of a portable radio communication device, such as a mobile phone. The distance to the edges is at least one millimeter. Two feeding points 6 of the transmitting antenna element 5 are shown at the top of the PCB 1.

The receiving antenna element 11 is a loop antenna positioned between the transmitting antenna element 5 and one edge of the PCB. The loop antenna is positioned perpendicular to the planar antenna. Two feeding points 12 of the receiving antenna element 11 are shown near the top of the PCB 1.

Although the above mentioned antenna elements have been described as being planar or loop antennas they may be of any internal antenna type, such as: PIFA, strip antenna, meander antenna, etc.

Further, to provide multi band coverage of a mobile phone a transmitting antenna and a receiving antenna, respectively, may be arranged to resonate in several frequency bands, or a mobile phone may be provided with several transmitting antennas and receiving antennas, each of which is arranged to resonate in one frequency band. It is also possible to combine single frequency band antennas with multi frequency band antennas.

Figure 7:
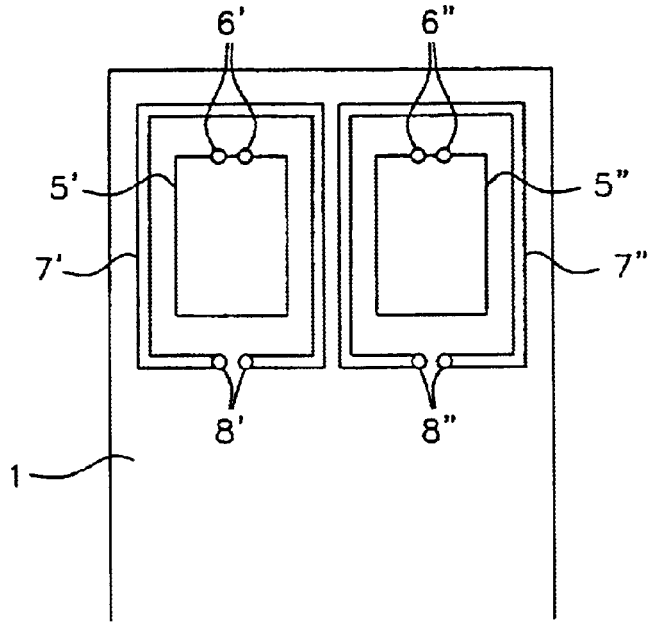
FIG. 7 is a schematic top plan view of an embodiment of an antenna arrangement according to the present invention.

With a second transmitting antenna element and a second receiving antenna element as shown in FIG. 7 provided in a mobile phone, multiband coverage may be obtained wherein each antenna resonates in only one frequency band.

Figure 6:
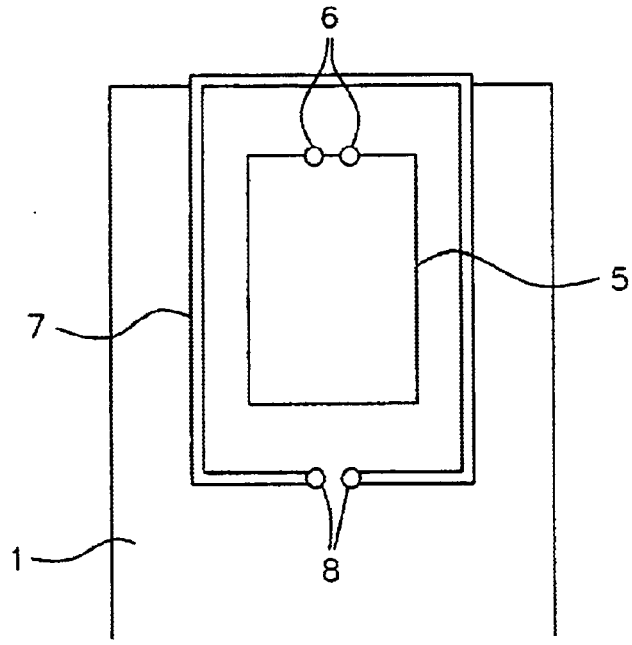
FIG. 6 is a schematic top plan view of an embodiment of an antenna arrangement according to the present invention.

As mentioned above a receiving antenna contributes very little to SAR and it is thus quite possible to position the receiving antenna element partly outside the general outline of a PCB as shown in FIG. 6, without significantly increasing SAR. A receiving antenna element may thus e.g. have a planar portion parallel to the PCB and a folded portion, folded around one or more edges of the PCB.

It will be obvious that the present invention may be varied in a plurality of ways. Such variations are not to be regarded as departure from the scope of the present invention. All such variations as would be obvious for a person skilled in the art are intended to be included within the scope of the present invention.

What is claimed is:

1. An antenna arrangement for a portable radio communication device including a casing, said casing housing a generally planar printed circuit board (1) defining a ground plane device, said antenna arrangement comprising:

a first antenna element (4; 5) for transmission of radio signals mountable within said casing and connectable to said printed circuit board; and a second antenna element (7; 9; 11) for reception of radio signals mountable within said casing and connectable to said printed circuit board;

and being characterized in that said first antenna element, when mounted above said printed circuit board, has a projection on said printed circuit board, which is perpendicular to a plane parallel to said generally planar printed circuit board, wherein said first antenna element has a size and is positioned such that said printed circuit board extends, in all directions of said plane, farther than said projection, at least by a distance of one millimeter, and said second antenna element, when mounted above said printed circuit board, has a projection on said printed circuit board, which is perpendicular to said plane parallel to said generally planar printed circuit board, and wherein said second antenna element has a size and is positioned such that said projection of said second antenna element extends, at least in one direction of said plane, farther than said projection of said first antenna element.

2. The antenna arrangement as claimed in claim 1, wherein said first antenna element is essentially planar and mountable parallel to said printed circuit board.

3. The antenna arrangement as claimed in claim 1, wherein said second antenna element is positioned such that said printed circuit board extends, in all directions of said plane, farther than said projection of said second antenna element.

4. The antenna arrangement as claimed in claim 1, wherein said second antenna element is positioned such that said projection of said second antenna element extends, in at least one direction of said plane, farther than said printed circuit board.

5. The antenna arrangement as claimed in claim 1, wherein said first antenna element is positioned such that said projection of said first antenna element is equally distanced from two opposing edges of said printed circuit board.

6. The antenna arrangement as claimed in claim 1, wherein said antenna arrangement comprises:

a third antenna element for transmission of radio signals mountable within said casing and connectable to said printed circuit board; and a fourth antenna element for reception of radio signals mountable within said casing and connectable to said printed circuit board;

wherein said third antenna element, when mounted above said printed circuit board, has a projection on said printed circuit board, which is perpendicular to said plane parallel to said generally planar printed circuit board, and wherein said third antenna element has a size and is positioned such that said printed circuit board extends, in all directions of said plane, farther than said projection of said third antenna element, at least by a distance of one millimeter.

7. The antenna arrangement as claimed in claim 1, wherein said distance is at least two millimeters.

8. The antenna arrangement as claimed in claim 1, wherein said distance is at least three millimeters.

9. The antenna arrangement as claimed in claim 1, wherein said first antenna element is unbalanced and said second antenna element is balanced.

10. The antenna arrangement as claimed in claim 1, wherein said first antenna element is balanced and said second antenna element is unbalanced.

11. A portable radio communication device comprising:

a casing;

a generally planar printed circuit board (1) defining a ground plane device, provided in said casing;

a first antenna element (4; 5) for transmission of radio signals mounted within said casing and connected to said printed circuit board; and a second antenna element (7; 9; 11) for reception of radio, signals mounted within said casing and connected to said printed circuit board;

and being characterized in that said first antenna element has a projection on said printed circuit board, which is perpendicular to a plane parallel to said generally planar printed circuit board, wherein said first antenna element has a size and is positioned such that said printed circuit board extends, in all directions of said plane, farther than said projection, at least by a distance of one millimeter, and said second antenna element has a projection on said printed circuit board, which is perpendicular to said plane parallel to said generally planar printed circuit board, and wherein said second antenna element has a size and is positioned such that said projection of said second antenna element extends, at least in one direction of said plane, farther than said projection of said first antenna element.

12. The portable radio communication device as claimed in claim 11, wherein said first antenna element is essentially planar and mounted parallel to said printed circuit board.

13. The portable radio communication device as claimed in claim 11, wherein said second antenna element is positioned such that said printed circuit board extends, in all directions of said plane, farther than said projection of said second antenna element.

14. The portable radio communication device as claimed in claim 11, wherein said second antenna element is positioned such that said projection of said second antenna element extends, in at least one direction of said plane, farther than said printed circuit board.

15. The portable radio communication device as claimed in claim 11, wherein said first antenna element is positioned such that said projection of said first antenna element is equally distanced from two opposing edges of said printed circuit board.

16. The portable radio communication device as claimed in claim 11, wherein said first antenna element is balanced and said second antenna element is unbalanced.

17. The portable radio communication device as claimed in claim 11, wherein said first antenna element is unbalanced and said second antenna element is balanced.

* * * * *